United States Patent [19]

Martin

[11] Patent Number: 4,620,658

[45] Date of Patent: Nov. 4, 1986

[54] ASSEMBLY OF FRAMES

[75] Inventor: Gerald Martin, Shrewsbury, England

[73] Assignee: Textron, Inc., Providence, R.I.

[21] Appl. No.: 648,167

[22] PCT Filed: Dec. 22, 1983

[86] PCT No.: PCT/GB83/00343

§ 371 Date: Aug. 31, 1984

§ 102(e) Date: Aug. 31, 1984

[87] PCT Pub. No.: WO84/02677

PCT Pub. Date: Jul. 19, 1984

[30] Foreign Application Priority Data

Dec. 31, 1982 [GB] United Kingdom ..... 8237049

[51] Int. Cl.[4] ..... B27M 3/00

[52] U.S. Cl. ..... 227/152; 227/111; 227/154; 227/155

[58] Field of Search ..... 227/152, 154, 155, 111; 100/913

[56] References Cited

U.S. PATENT DOCUMENTS

| | | | |
|---|---|---|---|
| 3,564,702 | 2/1971 | Hurn et al. | 29/430 |
| 3,576,286 | 4/1971 | Bunch | 227/2 |
| 3,592,376 | 7/1971 | Moehlenpah | 227/101 |
| 3,628,714 | 12/1971 | Offenwanger | 227/7 |
| 3,711,007 | 1/1973 | Fry | 227/101 |
| 3,848,791 | 11/1974 | Jureit | 227/100 |
| 4,002,116 | 1/1977 | Knowles | 227/152 |
| 4,133,097 | 1/1979 | Slade | 29/564.8 |
| 4,305,538 | 12/1981 | Schultz | 227/111 |

*Primary Examiner*—Robert L. Spruill
*Assistant Examiner*—Taylor J. Ross
*Attorney, Agent, or Firm*—Cushman, Darby & Cushman

[57] ABSTRACT

A machine for the assembly of frames, e.g. of timber, comprises a first static assembly (6), and a second assembly (8) mounted for longitudinal movement relative to the first assembly (6). The static assembly (6) comprises two adjustable side assemblies (16), and supporting assemblies, comprising support members (20, 22) providing parallel spaced supporting surfaces (23) on which elongate frame members (26) may be positioned. The moving assembly (8) carries clamping devices (60) each of which provides a datum surface, and an air cylinder to move the datum surface between operative and retracted positions, and a power operated clamp member to urge a transverse component (120) of the frame into engagement with the two datum surfaces. In the use of the machine, with the moving assembly (8) at a start position, parallel elongate frame members (26) are placed on the supporting surfaces (23), and a transverse frame member (120) is placed between the members (26), and the clamping devices (60) are operated to clamp the member (120) at a desired position, said clamping devices (60) operating from beneath the plane containing the longitudinal members (26) and the transverse member (120). Supplementary clamping members (112) are then operated to hold the longitudinal frame members (26) and the transverse frame member (120) in position, while fasteners (which may be in the form of nails) are applied by nailing guns (100). The clamping devices (60) are then withdrawn and the moving assembly (8) is moved lengthwise of the static assembly (6) and the abutment members (66) are moved to their operative positions to provide datum surfaces defining the position against which the second transverse member (120) of the frame is to be secured. The assembly (8) is thus moved stepwise lengthwise of the side members (26), stopping at intervals while transverse frame members (120) are nailed between the longitudinal members (26).

24 Claims, 15 Drawing Figures

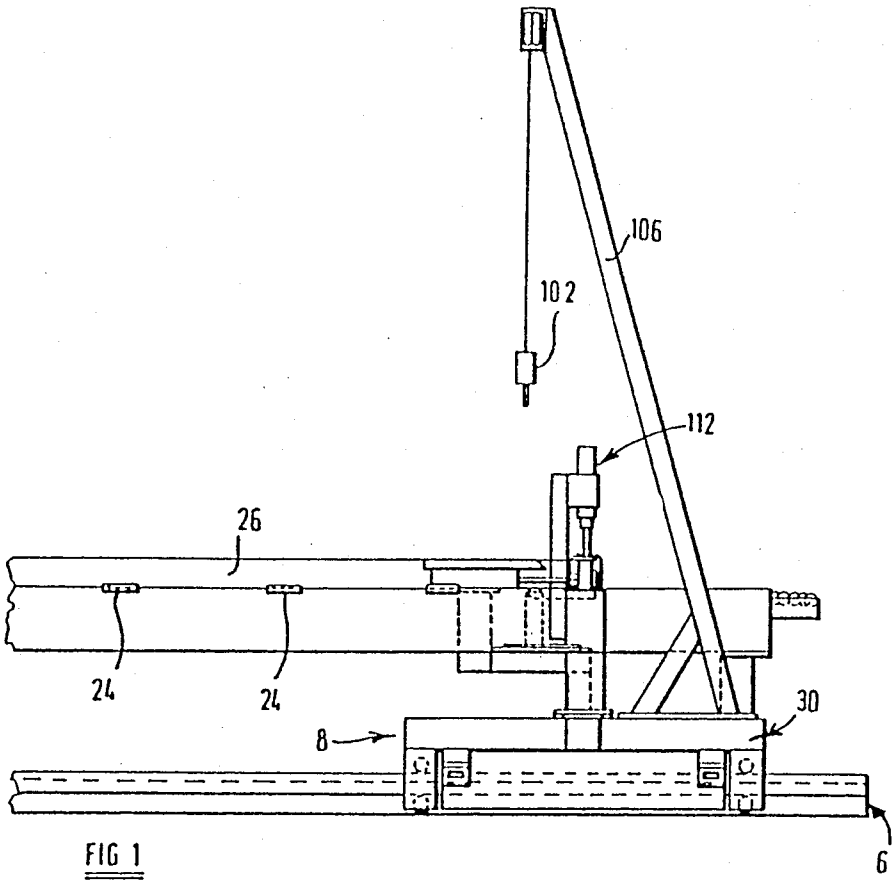
FIG 1
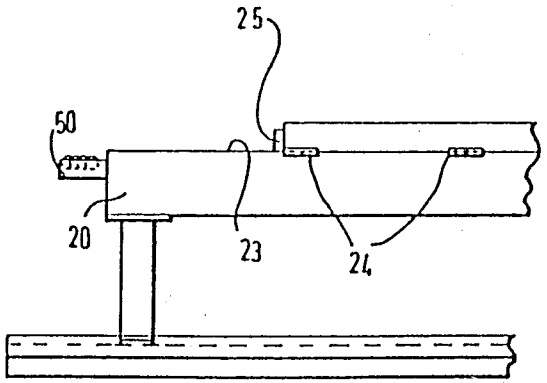

ASSEMBLY OF FRAMES

This invention is concerned with improvements relating to machines for the assembly of frames, and has been devised particularly for use in the assembly of frames from timber by the use of nails, and the invention will be described hereinafter particularly in this context. It is however to be appreciated that the invention may be used to advantage in the assembly of frames other than of components of timber (e.g. plastics material or metal) and by the use of fasteners other than nails (e.g. screws or rivets).

Timber frames for use in the building industry generally comprise parallel elongate members (generally termed "stringers") between which transverse members are secured, such transverse members generally being termed "studs".

In one example of the use of such a frame, the frame is erected in position with the studs extending vertically, and an outer skin of the building (which may be brickwork) is secured to the studs.

The spacing between the studs depends upon the design of the building for which the frame is intended, and the position in the building which the frame occupies, and thus varies from frame to frame. Because of this, difficulty has been experienced in providing a machine which may conveniently be used in the assembly of timber frames and which is economical as to its operator requirements.

Additional difficulty is encountered where it is desired to secured to and between adjacent studs one or more further longitudinal members such as (in relation to the building industry) "noggins", or further transverse members which do not extend wholly from one longitudinal member to the other, as is the case of cripple studs and sill studs.

According to this invention, there is provided a machine for the assembly of frames comprising:

(a) a first assembly which provides means for locating a pair of longitudinal frame members in parallel spaced relationship;

(b) a second assembly mounted for longitudinal movement relative to the first assembly;

(c) drive means adapted to move the second assembly longitudinally relative to the first assembly in a stepwise manner;

(d) clamping means carried by the second assembly and which is operative on termination of movement of the second assembly to clamp a transverse frame member in fixed position relative to the first assembly; and (e) fastener applying means carried by the second assembly and operative subsequent to operation of the clamping means to apply fasteners to secure such a transverse member to each of the longitudinal members.

In this manner, the second assembly may be moved relative to the first assembly in steps, the distance between which being equal to the spacing between the centrelines of the transverse members, the clamping means may be operated to clamp a transverse member positioned between the longitudinal members at the desired position, and the fastener applying means operated to secure the transverse member to the longitudinal members.

Preferably the first assembly also provides means for supporting transverse frame members extending between said longitudinal frame members. In this manner, a transverse member may be positioned between said longitudinal members at or adjacent to its desired position when the second assembly is stationary longitudinally relative to the first assembly, so that such a transverse member is at or adjacent to its desired position for operation of the clamping means.

Preferably the first assembly comprises a base, and two spaced side assemblies, each comprising a horizontally extending, elongate supporting member, said supporting members each providing means for supporting one of said longitudinal frame members, and locating them in spaced parallel relationship. Preferably at least one of the side assemblies is mounted on the base for lateral movement towards and away from the other, whereby the distance of separation of the supporting members may be varied in accordance with the desired spacing between the longitudinal frame members.

Preferably the second assembly extends between said side assemblies beneath the supporting members thereof. In this manner, the clamping means carried by the second assembly may gain operative access to components of or for the frame from a direction from beneath the frame.

The drive means may be adapted to move the second assembly longitudinally relative to the first assembly by manual operation or by means of a drive motor.

Conveniently the first and second assemblies are provided with interengaging formations such as a rack which may extend longitudinally of the first assembly and a pinion on the second assembly, the pinion being adapted to be rotated either manually by means of a hand wheel, or by such drive motor. Preferably two racks are utilised, one on each of the side assemblies, and two pinions, one on each side of the second assembly, said pinions advantageously being connected by a transverse shaft.

Where the drive means comprises a drive motor, advantageously means is provided for pre-setting the extent of operation of the drive motor in each step, whereby the second assembly may be moved longitudinally relative to the first assembly in steps of desired, predetermined magnitude.

Where the drive means is adapted for manual operation, preferably a scale is provided which extends longitudinally of the machine, enabling the operator to move the second assembly into its desired position at each stage in the operation of the machine, in accordance with markings which may be aligned with the scale.

Preferably the second assembly is adjustable, to accommodate for change in the spacing between the two side assemblies.

Preferably the clamping means provides a datum surface, conveniently provided by an abutment member, mounted for movement between an operative position in which it extends at least partially into a plane containing the longitudinal members and a retracted position in which it does not so extend, and is moved to its retracted position subsequent to operation of the fastener applying means whereby the datum surface may pass downstream of the secured transverse member during the next step in the movement of the second assembly.

Preferably the clamping means also comprises means by which the position of the datum surface may be varied. For example, the clamping means may comprise a plurality of abutment members adapted to provide datum surfaces at different positions longitudinally of the machine, allowing the operator to move an appropriate one of said abutment members to its retracted position when the second assembly comes to rest.

Preferably the clamping means is provided by a clamping device which also comprises a clamping member movable towards and away from the datum surface when in its operative position, and power operated means to move the clamping member towards the datum surface to clamp a transverse member against the datum surface when the second assembly comes to rest.

Preferably the machine comprises two such clamping devices, one located adjacent each of the supporting means, and preferably at least one of said clamping devices is positionally adjustable transversely of the machine on the second assembly to accommodate for change in position between the two side assemblies.

Preferably the machine comprises further clamping devices carried by the second assembly and which are operative when the second assembly comes to rest to clamp the longitudinal frame members and/or a transverse frame member against the supporting members at a position adjacent to the position of operation of the fastener applying means.

Preferably the second assembly comprises one or more additional supporting devices which extend longitudinally of the machine for supporting further longitudinal frame members as may be required to be secured to and between the transverse frame members, or further transverse frame members which do not extend fully from one longitudinal frame member to the other. Preferably such additional supporting devices provide support surfaces on which a transverse frame member rests on being placed between the longitudinal frame members, whereby when it is desired to secure such a further longitudinal member to a transverse member, such support surface provides a stable base against which a supplementary fastener-applying operation may be carried out, and which continues to support such a further longitudinal member as the second assembly is advanced a further step.

Such additional supporting devices may comprise additional clamping means to enable a component to be clamped in position prior to such securement.

Preferably the second assembly carries a supplementary fastener applying device, which may conveniently be adapted for operator actuation, conveniently suspended above the plane in which the longitudinal members extend by a flexible, conveniently extensible, cable.

Preferably the first assembly carries conveyor means by which a frame assembled by the machine may be conveyed therefrom. Preferably the conveyor means comprises lifting means to lift the longitudinal members from the supporting means, and roller means whereby the frame may be rolled from the machine either manually or automatically. Preferably such conveyor means is provided by two elongate roller devices, each extending adjacent to one of the supporting members and which are movable between retracted positions in which they extend beneath the plane in which the longitudinal frame members extend, and operative positions in which they lift the frame from the supporting means.

According to this invention, there is also provided a method of assembling a frame, in which longitudinal members of the frame are secured horizontally in spaced, parallel relationship, and a transverse member of the frame is positioned between said longitudinal members and is secured in position by means operating from beneath the plane containing the longitudinal members whilst the transverse member is secured to the longitudinal members.

There will now be given a detailed description, to be read with reference to the accompanying drawings, of a machine for assembling frames which is a preferred embodiment of this invention, and which has been selected for the purposes of illustrating the invention by way of example.

In the accompanying drawings:

FIG. 1 is a side elevation of the machine;

Figure 2:
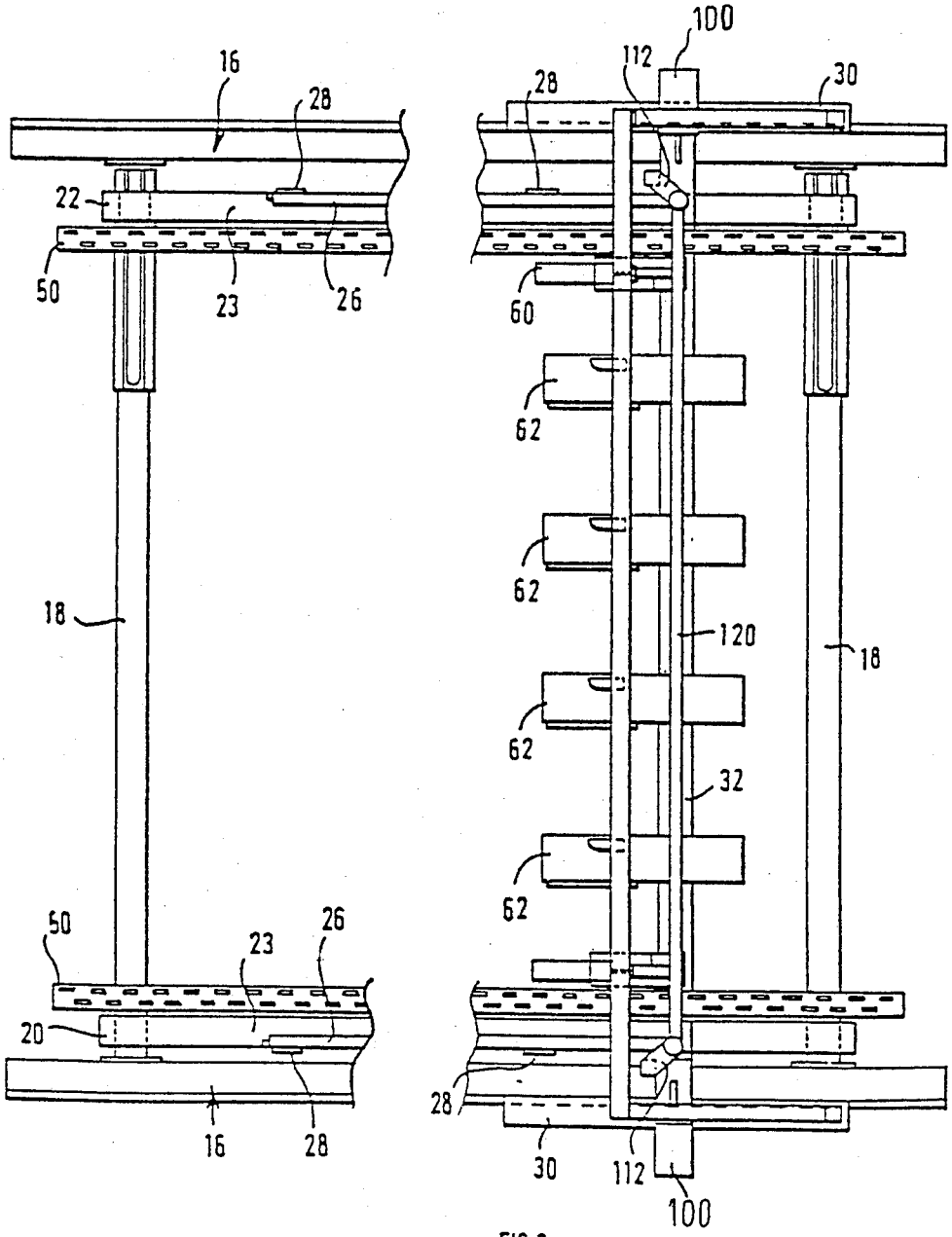
FIG. 2 is a plan view of the machine.

The machine which is the preferred embodiment of this invention comprises a first, static assembly 6, a second, moving assembly 8 mounted for longitudinal movement relative to the first assembly, drive means 10 adapted to move the second assembly longitudinally relative to the first assembly in stepwise manner, and clamping devices carried by the second asembly.

The static frame 6 comprises a horizontal base 14, and two side assemblies 16 extending upwardly from the base. Extending between each of the two side assemblies 16 are spaced transverse supports 18. Mounted on and between the two transverse supports 18 are spaced supporting assemblies, one of which is fixed and comprises a supporting member 20, the other being capable of movement lengthwise of the transverse supports, and comprises a supporting member 22.

Each supporting member 20 and 22 provides a supporting surface 23 from which securing means in the form of sharp-pointed elements 24 extend upwardly, whereby an elongate element 26 of a frame (said elongate element hereinafter being referred to for convenience as a "stringer") may be placed in engagement therewith and in engagement with a side stop 28 secured to the supporting member, whereby the stringer is restrained against undesired movement.

The second assembly 8 comprises two carrier assemblies 30, one positioned outwardly of each of the side assemblies 16, and an intermediate support member 32 extending between the carrier assemblies through the side assemblies 16. Each carrier assembly comprises a bracket 34 secured to and extending downwardly from the intermediate support member 32, each bracket 34 mounting rollers 36, 38 which engage with a rail 40 secured to a static base member 15 of the base 14 to guide the carrier assemblies, and hence the second assembly, for longitudinal movement relative to the static assembly 6.

The drive means 10 comprises a shaft 42 supported beneath the intermediate support member 32 on downwardly-depending brackets 41, said shaft 42 carrying at each of its opposite ends a pinion 44. Each pinion 44 engages a static rack 46 secured to one of the static base members 15, longitudinally of the static assembly 6.

Thus by rotation of the shaft 42, the pinions 44 thereof may be caused to rotate, and being in engagement with the static racks 46, the assembly 8 as a whole may be caused to move longitudinally on the static assembly 6, such movement being guided by the engagement of the rollers 36 and 38 with the rail 40.

Figure 5:
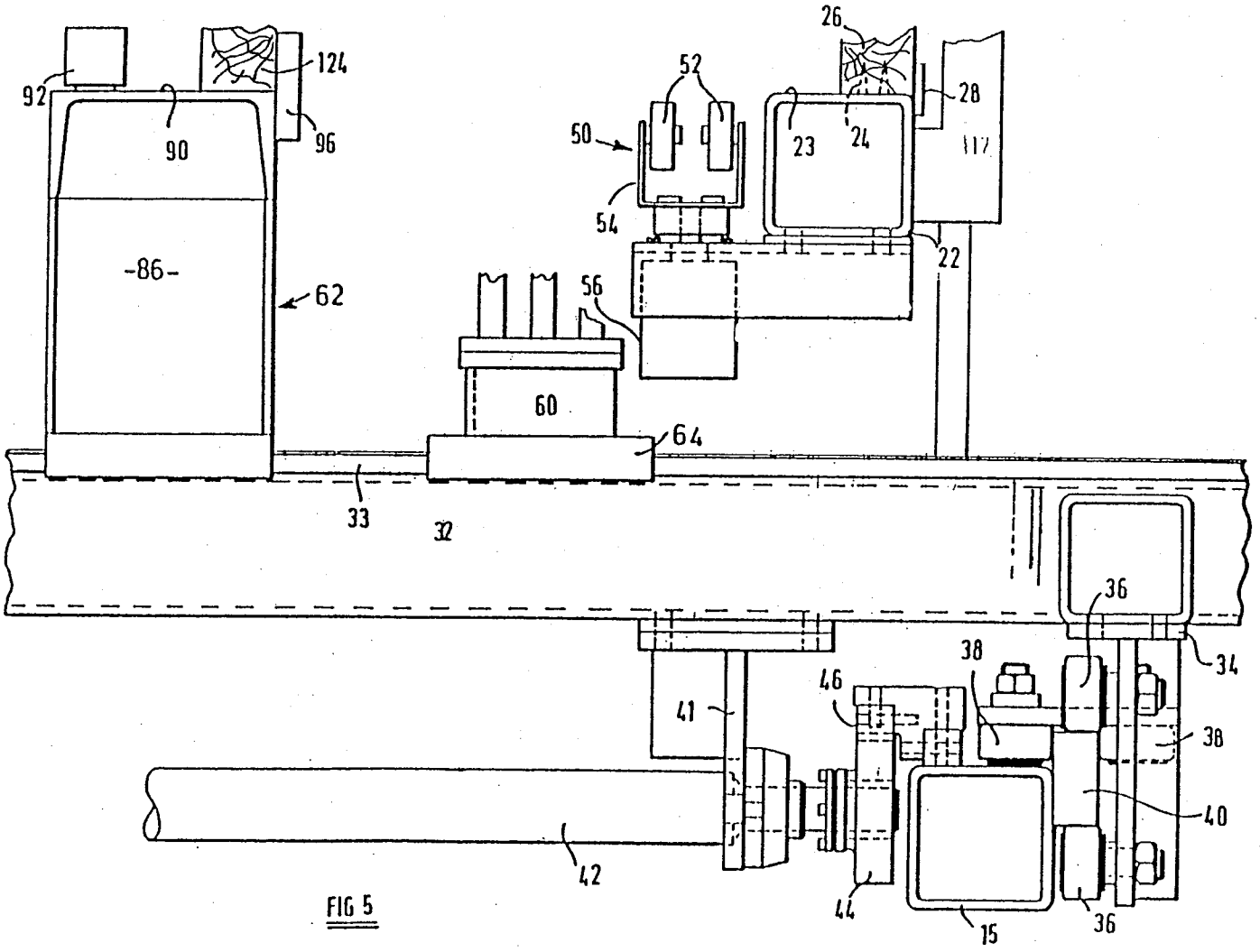
FIG. 5 is an enlarged end elevation of part of the machine.
Figure 7:
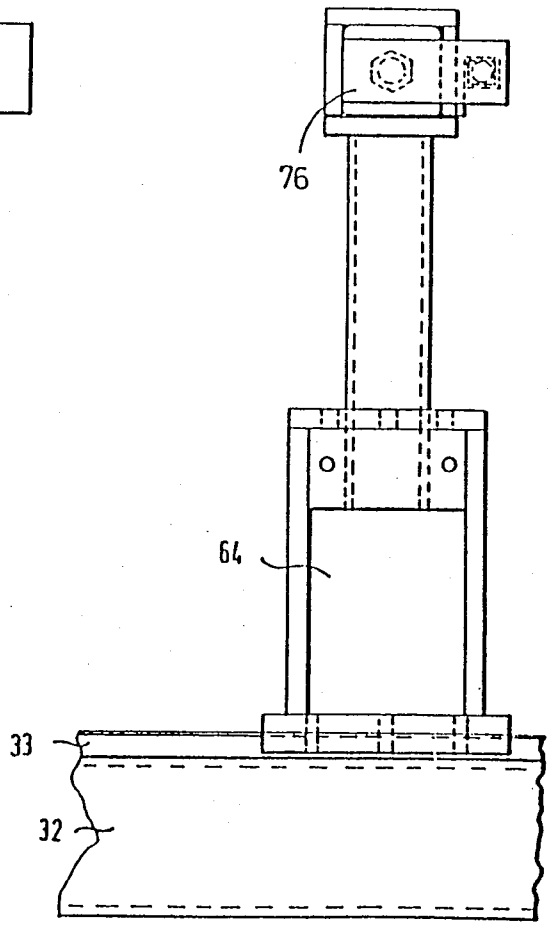
FIG. 7 is an end elevation of part of the device shown in FIG. 6.

Each of the elongate horizontal supporting members 20 and 22 carries a conveyor assembly 50, afforded by a longitudinal series of rollers 52 mounted on a base 54, power operated means 56 being provided to move the conveyor assembly 50 between a retracted position, as is shown in FIG. 5, in which the rollers 52 are located below the plane of the supporting surfaces 23 of the supporting members 20 and 22, and an operative position in which the rollers extend above such plane.

Secured to an upper surface of the intermediate support member 32 is a dovetail member 33, having provided in its upper surface a scale rule 33*a*. Slidably mounted on the dovetail member 33 are two clamping devices 60, one located adjacent to each of the conveyor assemblies 50, and four supplementary supporting devices 62, each comprising clamping means, in the form of a lever 63, whereby the member may be clamped in a desired transverse position on the dovetail member 33.

Figure 6:
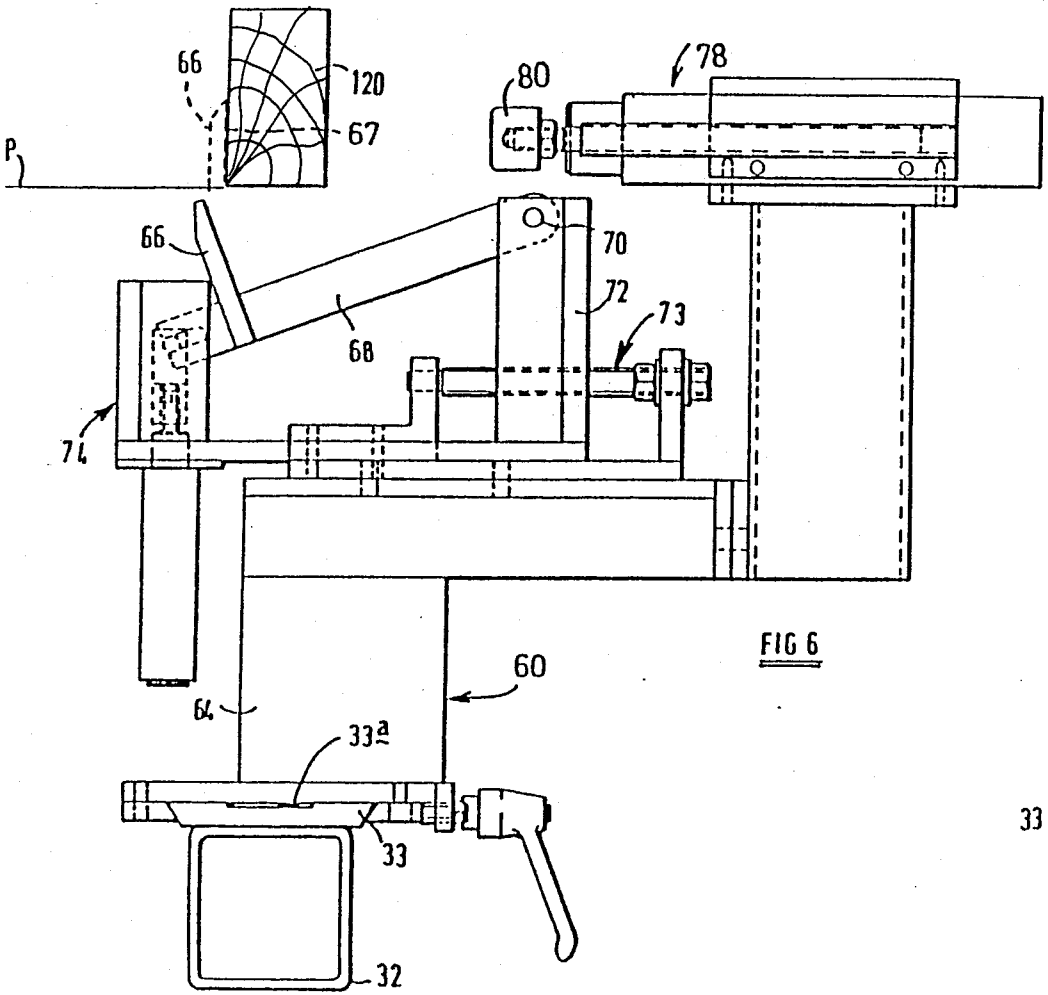
FIG. 6 is a side elevation of a clamping device of the machine.

Each clamping device 60 comprises a base 64, provided with a dovetail grove mounted over the dovetail member 33, and which extends upwardly from the intermediate support member 32, on an upper end of which is mounted on abutment member 66 mounted on an arm 68 for pivotal movement about an axis 70 provided on a carrier member 72 (see FIG. 6).

The clamping device also comprises power operated means 74 operative to move the abutment member 66 about the axis 70 between a retracted position (shown in full lines in FIG. 6) and an operative position (shown in dotted lines in FIG. 6). When in its retracted position, the stop member 66 is retracted beneath the plane of the surface which includes the supporting surfaces 23 (indicated P in FIG. 6) and when in its operative position, provides a datum surface 67 corresponding to the desired position of a transverse member (hereinafter referred to as a stud) to be secured to and between the stringers 26. In addition, the longitudinal position of the carrier member 72 may be adjusted to compensate for the thickness of the transverse member by a screw-thread adjustment 73.

In particular, each of the clamping devices 60 comprises three abutment members 66, each providing a datum surface in a different position longitudinally of the machine, the clamping devices each comprising means to enable an operator to select the appropriate abutment member 66 for operation, to provide a datum surface in the required position, for reasons explained more fully hereinafter.

Also mounted on the base 64 is a fluid operated piston/cylinder device 78, carrying at its operative end a head 80 which affords a stud clamp.

Figure 9:
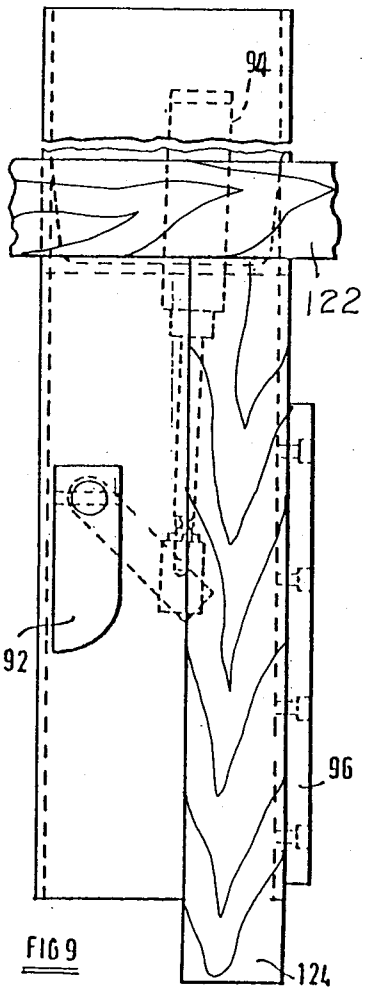
FIG. 9 is an end elevation of the further supporting device shown in FIG. 8.
Figure 8:
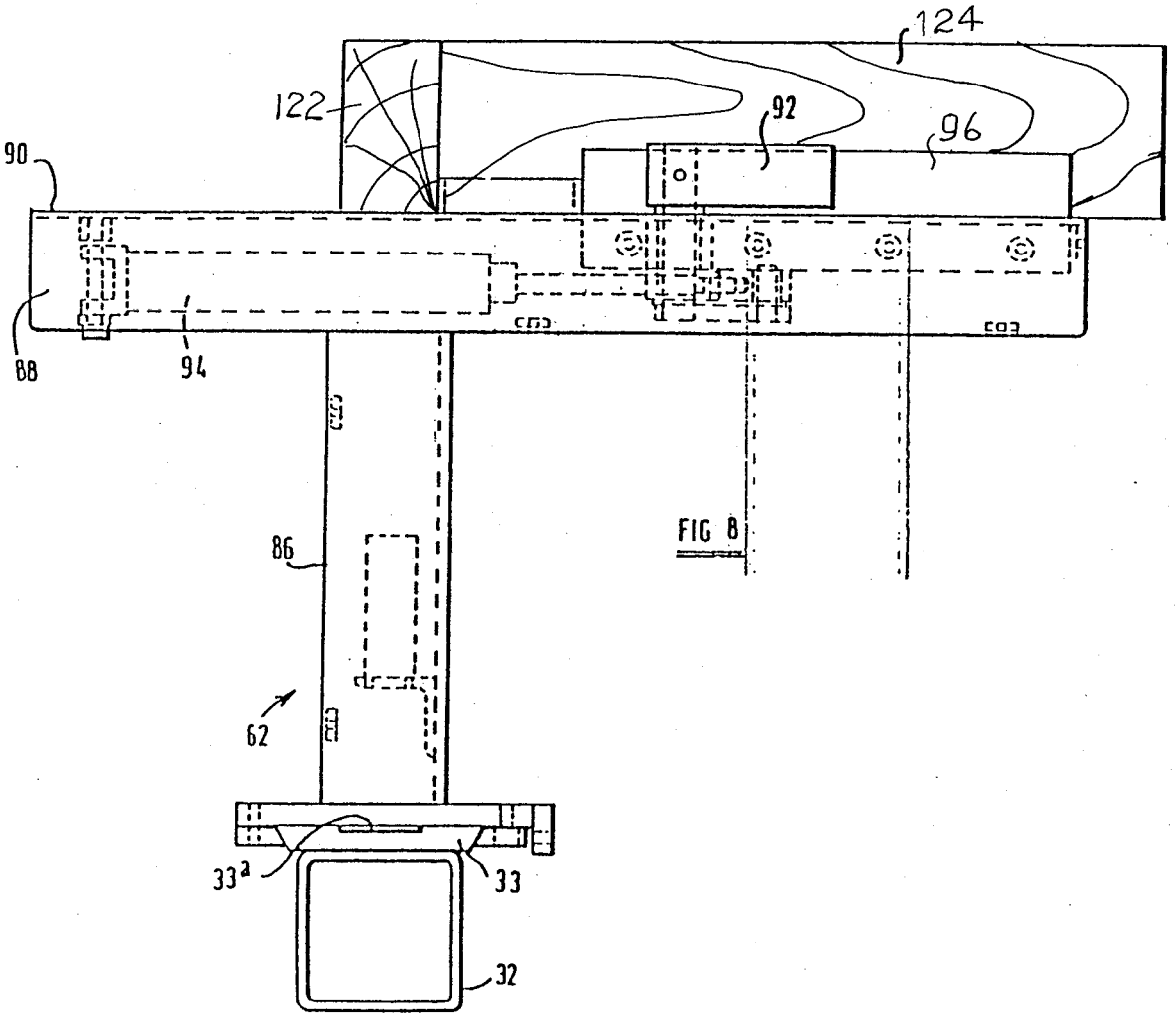
FIG. 8 is a side elevation showing a further supporting device of the machine.
Figure 10:
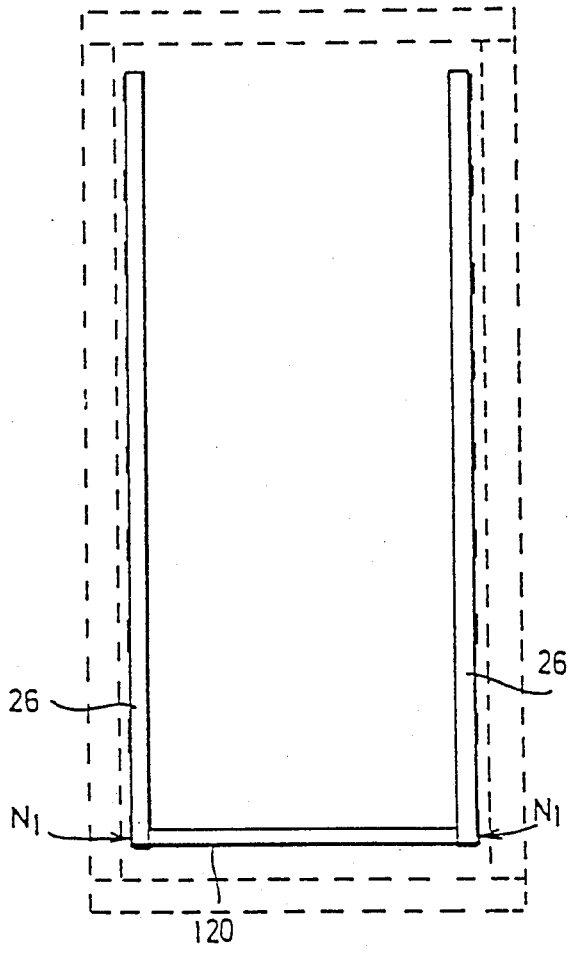
FIGS. 10 to 15 are schematic views illustrating the assembly of a frame by the use of the machine.
Figure 11:
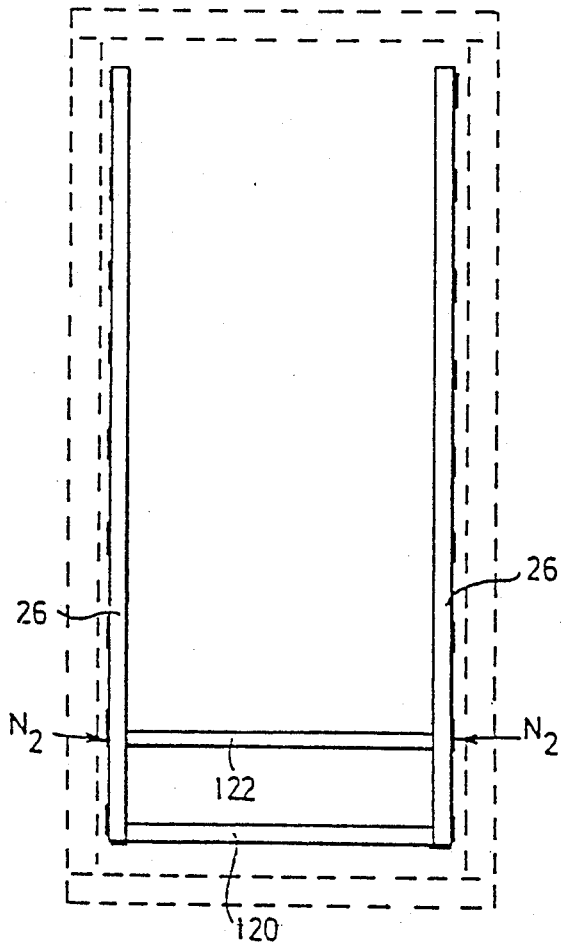
Figure 12:
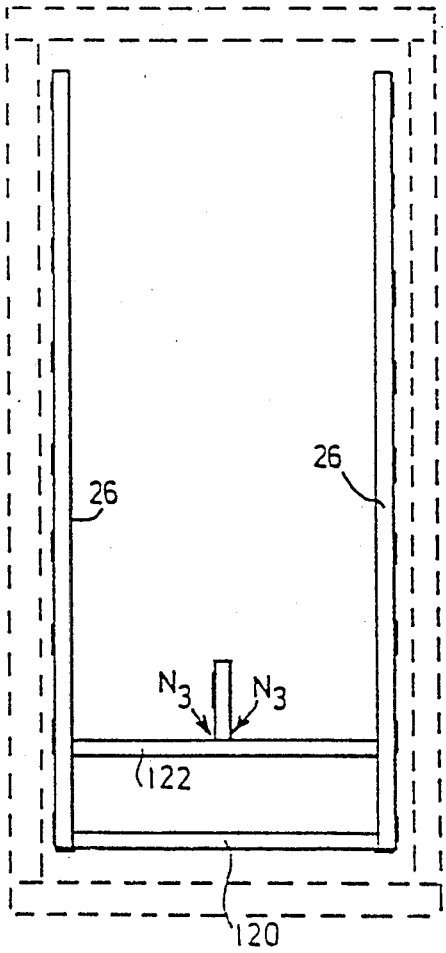

Each of the supplementary supporting devices 62 comprises a base 86 extending upwardly from the support member 32. At its upper end, each base 86 carries a supplementary supporting member 88 which is elongate in a direction longitudinally of the machine, providing a support surface 90 which lies in the plane containing the supporting surfaces 23. Extending upwardly from the surface 90 is a clamping member 92, power operated means 94 being provided to move the clamping member between a retracted position (shown in full lines in FIG. 9) and an operative position in which it is displaced in and anti-clockwise direction by some 45°.

Figure 3:
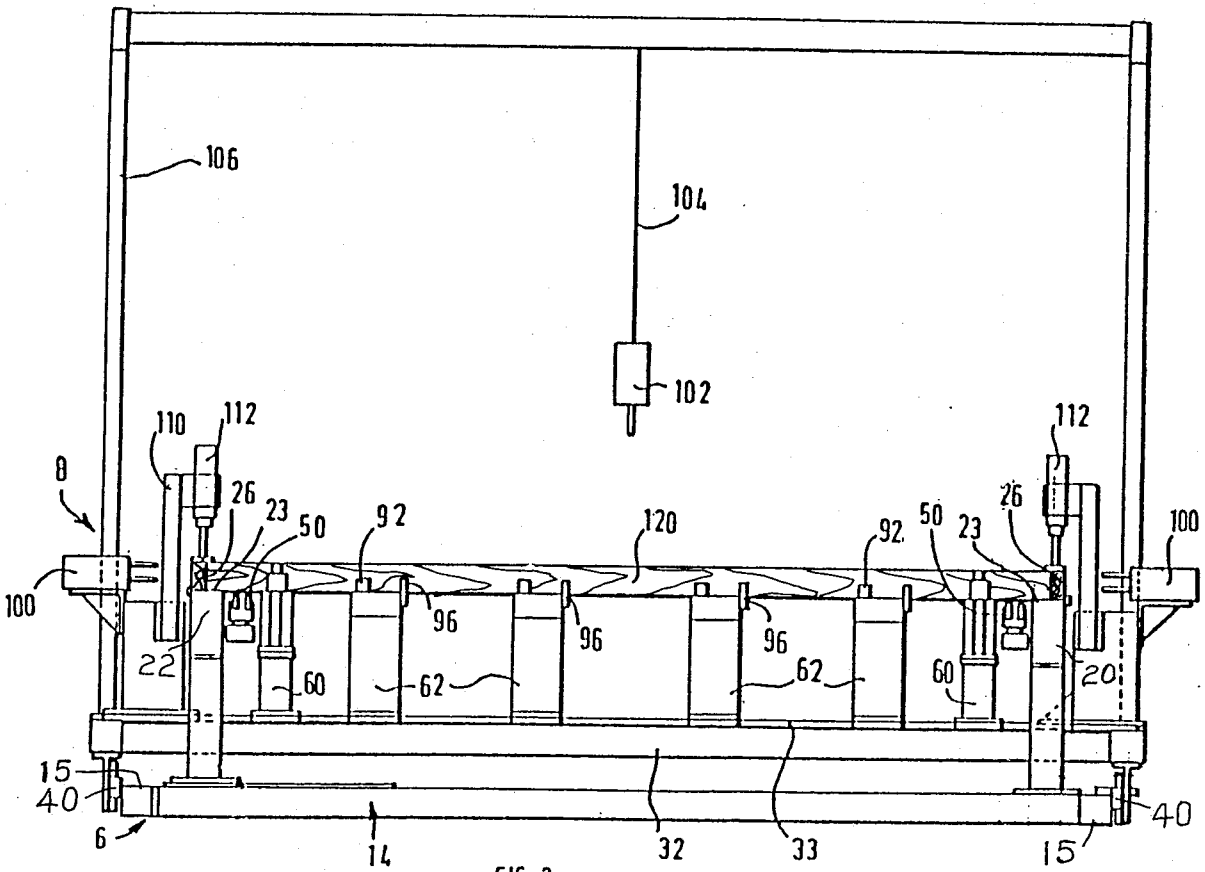
FIG. 3 is an end elevation of the machine.
Figure 4:
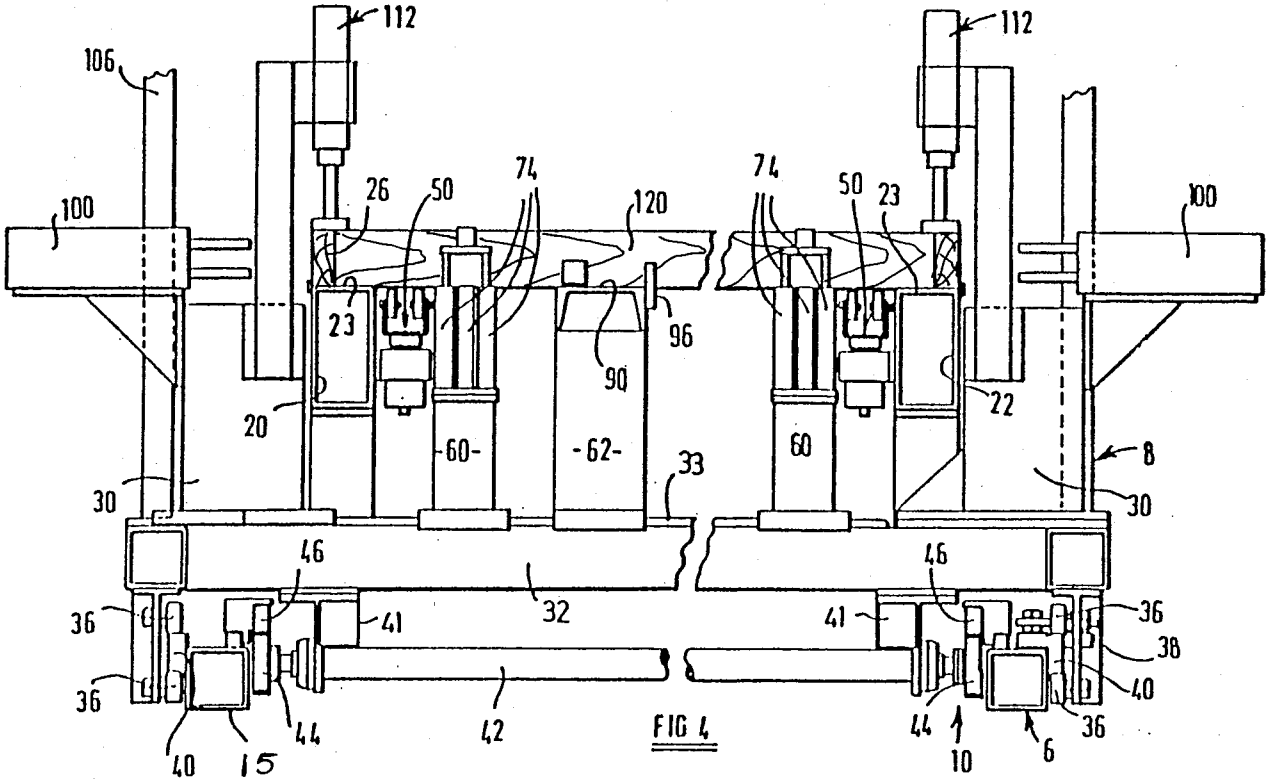
FIG. 4 is an enlarged end elevation of the outer parts of the machine.

Secured to the right hand side of each supplementary support member 88 (as seen in FIG. 3) is an abutment member 96, which affords a side stop of the device.

The machine which is the preferred embodiment of this invention also comprises fastener applying means, conveniently in the form of automatic nailing guns. The fastener appying means comprises two nailing guns 100, one being mounted on each of the carrier assemblies 30, a third nailing gun 102 being suspended by a flexible, preferably extensible, cable 104 from a cantilever assembly 106 extending upwardly from the carrier assemblies.

Mounted on supports 110 extending upwardly from each carrier assembly 30 is a supplementary clamping device 112, comprising a fluid operated postion/cylinder device 114 carrying on the outer end of the piston thereof a clamping head 116, the supplementary clamping devices 112 being located above the side assemblies 16 and 18, and generally in line with the nailing guns 100.

The operation of the machine which is the preferred embodiment of this invention will now be described in relation to the assembly of a timber frame for use in the building assembly, and with particular reference to FIGS. 10 to 15 of the accompanying drawings.

The positionally adjustable supporting member is moved on the base 14 into a position such that the distance of separation of the side stops 28 on the two supporting members 20 and 22 corresponds to the desired width of the frame.

The second assembly 8 is moved to its start position, and stingers 26 are positioned on the supporting members 20 and 22 in engagement with the side stops 28 and in engagement with transverse end stops 25. The first stud 120 is placed between the stringers 26, the supporting members 20, 22 being sufficiently wide in the transverse direction as to provide support for said stud, and a first stage in the operation of the machine is commenced. This involves movement of the two clamping devices 60 into their operative positions, the abutment member 66 being moved to its advanced position, and the power operated device 76 is operated to cause the clamping head 80 to press the stud 120 into engagement with the abutment member 66, ensuring engagement between the stud 120 and the datum surface 67 of the member 66, ensuring in consequence a correct positioning of the stud 120.

The supplementary clamping devices 112 are also operated, pressing the stringers 26 into engagement with the surfaces 23, causing the formations 24 to enter into the stringers to prevent subsequent movement thereof relative to the supporting surfaces 23, and also pressing the stud 120 into engagement with the surface 23 to ensure correct horizontal alignment of the stud with the stringers. The nailing guns 100 are then automatically operated, each to drive two nails through the adjacent stringer 26 and into the end of the stud 120 as indicated $N_1$ (see FIG. 10).

The clamping members are then retracted, and the abutment members 66 thereof moved to their retracted position, and the supplementary clamping devices 112 are released and the drive means 10 is operated to cause rotation of the pinions and movement of the moving assembly 8 longitudinally relative to the static frame 6.

On completion of the first step in the advancement of the assembly 8, the operator will place a second stud 122 at or adjacent its desired position, specifically between the abutment member 66 and the head 80 of each of the clamping devices 60. Thus on actuation of the clamping devices, the abutment member will move into its advanced position as shown in dotted lines in FIG. 6, and the power operated means 78 will cause the head 80 to move the stud into engagement with the datum surface 67 ensuring that the stud 122 is in its desired position. The supplementary clamping devices 112 will similarly be actuated to ensure horizontal alignment between the stud and the stringers, and the nailing guns 100 will be operated to nail the stud to the stringers as indicated $N_2$ (see FIG. 11).

Prior to further advancement of the second assembly 8, a further longitudinal member in the form of a noggin 124 is positioned on one of the supplementary supporting devices 62, the power operated means 94 thereof being operated to move the clamping member 92 in an anti-clockwise direction (FIG. 9) to press the noggin against the side stop 96. The operator then nails the noggin 124 to the stud 122 by the use of the nailing gun 102 as indicated $N_3$ (see FIG. 12).

Figure 13:
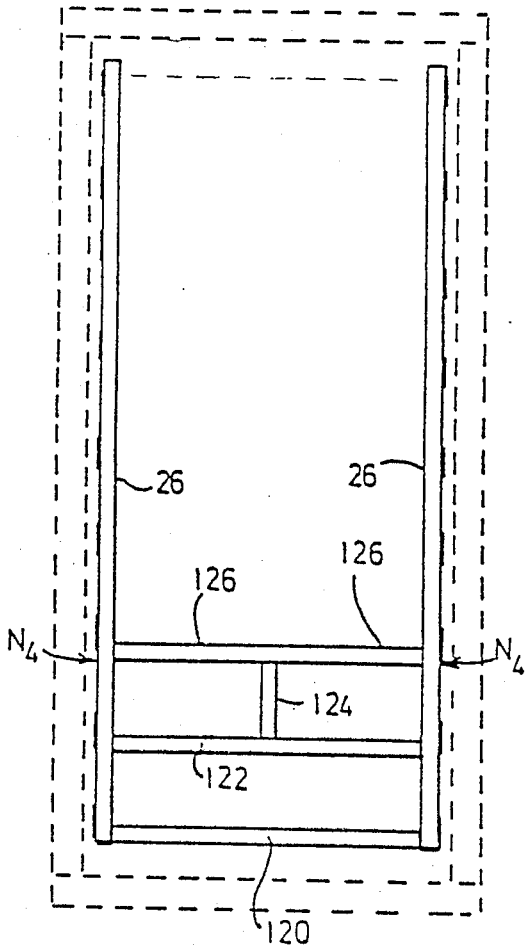

The various clamping devices are released, and the next step in the advancement of the assembly 8 is initiated, and a third stud 126 is clamped in the desired position, and nailed to the stringers 26 by the nailing guns 100 as indicated $N_4$ (see FIG. 13).

The operation of the machine is continued, the second assembly 8 advancing longitudinally relative to the static assembly 6 during assembly of the frame, the supplementary supporting devices 62 being used as desired to provide support for noggins at desired positions during nailing thereof to adjacent studs.

Figure 14:
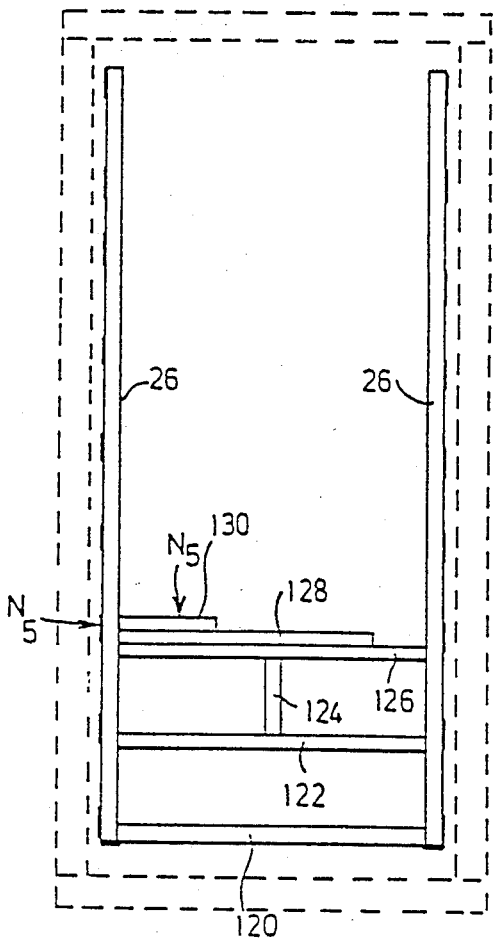
Figure 15:
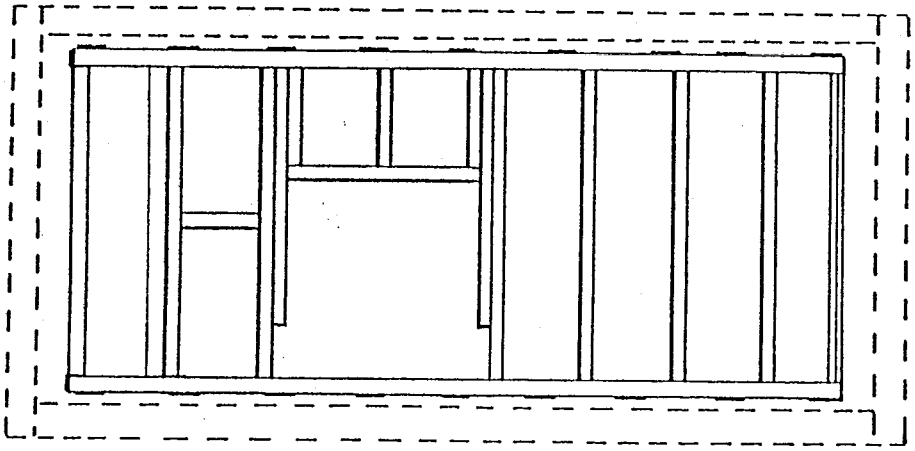

The capability of the operator to select any one of three datum surfaces of the clamping device enables either a single stud, or double or treble studs, at positions along the frame where the operator is clamping in position cripple and sill studs, to be accommodated for (as is illustrated in FIG. 14.

On completion of nailing between the stringers 26 the final stud, (see FIG. 15) with the various clamps released the conveyor assemblies 52 are operated, causing the rollers to move to their extended position, lifting the frame from the supporting surfaces 23 and allowing the frame to be rolled from the machine.

Stepwise movement of the machine may be effected by the use of a manual mechanism, and thus the drive means may comprise a hand wheel adapted to rotate the shaft 42, permitting the operator to move the assembly 8 lengthwise of the assembly 6 into its various positions, scales being provided longitudinally of the side assemblies to assist accurate positioning of the assembly 8 by the operator.

Preferably however the drive means comprises a drive motor to effect movement of the second assembly 8, operation of which being controlled by a computer, in conjunction with operation of the various clamping devices and nailing guns 100, as initiated by the operator.

By the use of the machine which is the preferred embodiment of this invention, the static bed allows one operator to progressively assemble a timber frame panel without the necessity of pre-setting location stops, noggins, sills etc., thereby enabling the operator to make consecutively panels having different internal designs, generally without any adjustment whatsoever with the possible exception of minor variations in positions of the noggin sill clamps.

The use of a static bed machine enables a frame to be clamped throughout the whole operation, leading to a more accurate frame than those produced from machines where the panel is moved from one nailing position to the next.

I claim:

1. A machine for fastening longitudinal and transverse frame members into a frame comprising a fixed stationary assembly including a pair of transversely spaced longitudinally extending support means for receiving and supporting a pair of longitudinal frame members in generally stationary operative positions wherein the pair of frame members are disposed in generally parallel coextensive relationship with respect to one another, said fixed stationary assembly providing access between said longitudinally extending support means enabling an operator to progressively move from an initial operating position between one pair of coextensive end portions of a pair of longitudinal frame members on said pair of support means in said stationary operative positions to a final operating position between the other pair of coextensive end portions of the pair of longitudinal frame members in said stationary operative positions, a transversely extending movable assembly mounted on said fixed stationary assembly for longitudinal movement from an initial position adjacent the initial operator operating position and a final position adjacent the final operator operating position, means for receiving and supporting successive transverse frame members in progressive longitudinally spaced operative positions extending transversely between the pair of longitudinal frame members on said pair of support means in said stationary operative positions, means carried by said movable assembly for releasably clamping (1) each successive transverse frame member on opposite sides thereof in the direction of longitudinal spacing thereof so as to releaseably hold the transverse frame member in its operative position and (2) the juncture between each successive transverse frame member in its operative position with each longitudinal frame member in a direction which is transverse with respect to both of the associated frame members, and means carried by said movable assembly for applying fastener means to each juncture during the clamping thereof by said releasable clamping means so as to fasten said juncture when released by said clamping means.

2. A machine as defined in claim 1 wherein the fixed and movable assemblies are provided with interengaging rack and pinion formations, and means to rotate the pinion to move said movable assembly longitudinally relative to said fixed assembly.

3. A machine as defined in claim 1 wherein said movable assembly carries a supplementary fastener applying device.

4. A machine as defined in claim 1 wherein said releasable clamping means comprises first clamping means for releasably clamping each successive transverse frame member, said first clamping means member, said first clamping means comprising two clamping devices, one located adjacent each of said support means.

5. A machine as defined in claim 4 wherein at least one of said clamping devices is positionally adjustable transversely of the machine on said movable assembly.

6. A machine as defined in claim 1 wherein said movable assembly comprises at least one additional supporting device which extends longitudinally of the machine.

7. A machine as defined in claim 6 wherein said additional supporting device provides a support surface on which a transverse member rests on being placed between the longitudinal members.

8. A machine as defined in claim 7 wherein said additional supporting device comprises additional clamping means.

9. A machine as defined in claim 1 wherein said fixed assembly comprises a base and two spaced side assemblies, each side assembly comprising a horizontally extending elongated supporting member, said supporting members providing said pair of support means.

10. A machine as defined in claim 9 wherein said movable assembly extends between said side assemblies beneath the supporting members thereof.

11. A machine as defined in claim 9 wherein at least one of the side assemblies is mounted on the base for lateral movement towards and away from the other, so that the distance of separation of the supporting members may be varied in accordance with the desired spacing between the longitudinal frame members.

12. A macihne as defined in claim 11 wherein the movable assembly is adjustable to accommodate variation spacing in between the two side assemblies.

13. A machine as defined in claim 1 wherein said movable assembly is provided with drive means for moving the same longitudinally with respect to said fixed assembly.

14. A machine as defined in claim 13 wherein said drive means comprises a drive motor, means for pre-setting the extent of operation of the drive motor between successive operative positions of said transverse frame members so that said movable assembly is moved longitudinally relative to said second assembly in steps of desired, predetermined magnitude.

15. A machine as defined in claim 13 wherein said drive means is adapted for manual operation, and a scale is provided which extends longitudinally of the machine enabling the operator to manually operate the movement of said movable assembly into its desired position at each successive operative position of the transverse frame members in the operation of the machine in accordance with markings which may be aligned with the scale.

16. A machine as defined in claim 1 wherein said releasable clamping means comprises a first clamping means for releasably clamping each successive transverse frame member, said first clamping means comprising an abutment member mounted for movement between an operative position in which a datum surface provided thereby extends at least partially into a plane containing the longitudinal frame members and a retracted position in which it does not so extend.

17. A machine as defined in claim 16 wherein said first clamping means also comprises power operated means to move said abutment member to its retracted position subsequent to the operation of said fastener applying means.

18. A machine as defined in claim 16 wherein said first clamping means also comprises a clamping member movable towards and away from the datum surface when in its operative position, and power operated means to move the clamping member towards the datum surface to clamp the transverse member against the datum surface when the movable assembly comes to rest.

19. A machine as defined in claim 16 wherein said releasable clamping means includes second clamping means for releasably clamping the juncture, said second clamping means comprising clamping devices operative when said movable assembly comes to rest to clamp the longitudinal members and/or a transverse member against said support means at a position adjacent to the position of operation of said fastener applying means.

20. A machine as defined in claim 16 wherein said first clamping means also comprises means by which the position of the datum surface may be varied.

21. A machine as defined in claim 20 wherein said first clamping means comprises a plurality of abutment members adapted to provide datum surfaces at different positions longitudinally of the machine, the positon of the datum surface being varied by selection by the operator of an appropriate one of said abutment members.

22. A machine as defined in claim 1 wherein said fixed assembly carries conveyor means by which a frame assembled by the machine may be conveyed therefrom.

23. A machine as defined in claim 22 wherein said conveyor means comprises lifting means to lift the longitudinal members from the supporting means, and roller means whereby the frame may be rolled from the machine.

24. A machine as defined in claim 22 wherein said conveyor means is provided by two elongate roller devices, each extending adjacent to one of the supporting members and which are movable between retracted positions in which they extend beneath the plane in which the longitudinal members extend, and operative positions in which they lift the frame from the supporting means.

* * * * *